US011365078B2

(12) United States Patent
Kawashita et al.

(10) Patent No.: US 11,365,078 B2
(45) Date of Patent: Jun. 21, 2022

(54) ELASTIC ROLL, NIP ROLL, AND CONVEYANCE DEVICE

(71) Applicant: Toray Industries, Inc., Tokyo (JP)

(72) Inventors: Mamoru Kawashita, Otsu (JP); Hiroki Shoji, Otsu (JP)

(73) Assignee: TORAY INDUSTRIES, INC., Tokyo (JP)

( * ) Notice: Subject to any disclaimer, the term of this patent is extended or adjusted under 35 U.S.C. 154(b) by 391 days.

(21) Appl. No.: 16/630,925

(22) PCT Filed: Jun. 5, 2018

(86) PCT No.: PCT/JP2018/021606

§ 371 (c)(1),
(2) Date: Jan. 14, 2020

(87) PCT Pub. No.: WO2019/021642

PCT Pub. Date: Jan. 31, 2019

(65) Prior Publication Data

US 2020/0231398 A1 Jul. 23, 2020

(30) Foreign Application Priority Data

Jul. 27, 2017 (JP) ..... JP2017-145171

(51) Int. Cl.
*B65H 27/00* (2006.01)
*B65H 20/02* (2006.01)

(52) U.S. Cl.
CPC ..... *B65H 27/00* (2013.01); *B65H 20/02* (2013.01); *B65H 2301/44318* (2013.01); *B65H 2301/5114* (2013.01); *B65H 2404/18* (2013.01); *B65H 2601/52* (2013.01)

(58) Field of Classification Search
CPC ..... B65H 27/00; B65H 20/02; B65H 2301/44318; B65H 2301/5114; B65H 2404/18; B65H 2601/52
See application file for complete search history.

(56) References Cited

U.S. PATENT DOCUMENTS 5,790,927 A 8/1998 Ando et al.

FOREIGN PATENT DOCUMENTS

CN 1165983 A 11/1997
CN 2707700 Y 7/2005
CN 201810769 U 4/2011
(Continued)

OTHER PUBLICATIONS

Chinese Office Action for Chinese Application No. 201880049699.7, dated Sep. 30, 2020 with translation, 13 pages.
(Continued)

*Primary Examiner* — William E Dondero
(74) *Attorney, Agent, or Firm* — RatnerPrestia

(57) ABSTRACT

An elastic roll includes: a roll core; an inner-layer laminate covering an outer-peripheral surface of the roll core parallel to a roll longitudinal direction; a surface-layer elastomer including a tubular portion covering an outer-peripheral surface of the inner-layer laminate, and edge portions connected to the tubular portion, covering both end surfaces of the inner-layer laminate orthogonal to the roll longitudinal direction, and arranged in a manner being in contact with the roll core; and end-portion sealing structural bodies configured to press the edge portions of the surface-layer elastomer against the roll core.

10 Claims, 8 Drawing Sheets

(56) References Cited

FOREIGN PATENT DOCUMENTS

| | | | |
|---|---|---|---|
| CN | 202609512 | U | 12/2012 |
| CN | 102877168 | A | 1/2013 |
| CN | 204878631 | U | 12/2015 |
| JP | 48110421 | U | 12/1973 |
| JP | 56144627 | U | 10/1981 |
| JP | 0973211 | A | 3/1997 |
| JP | 2000330374 | A | 11/2000 |
| JP | 2007193059 | A | 8/2007 |

OTHER PUBLICATIONS

International Search Report and Written Opinion for International Application No. PCT/JP2018/021606, dated Aug. 28, 2018, 4 pages.

(a)

(b)

(a)

(b)

ELASTIC ROLL, NIP ROLL, AND CONVEYANCE DEVICE

CROSS REFERENCE TO RELATED APPLICATIONS

This is the U.S. National Phase application of PCT/JP2018/021606, filed Jun. 5, 2018, which claims priority to Japanese Patent Application No. 2017-145171, filed Jul. 27, 2017, the disclosures of each of these applications being incorporated herein by reference in their entireties for all purposes.

FIELD OF THE INVENTION

The present invention relates to an elastic roll, and a nip roll and a conveyance device using the elastic roll.

BACKGROUND OF THE INVENTION

Web substrates such as paper and a plastic film may be subjected to various chemical solution treatments. Examples of the treatments include a process of immersing a substrate through a plating bath to electroplate the substrate and a wet coating process of applying a chemical solution. The examples also include a process of removing the chemical solution remaining on the substrate that has been subjected to the wet coating process and a wet cleaning process of using water or a cleaning fluid, for example, to clean a web substrate. Hereinafter, the wet coating process and the wet cleaning process as a whole are called "wet conveying process".

A web substrate is rarely completed as a product while being immersed in a chemical solution, and is commonly completed as a product under dry conditions. The web substrate that has been subjected to the wet conveying process is dried after removing the chemical solution therefrom, and is conveyed to the subsequent process. Outlines thereof will be described with reference to FIG. 6 illustrating one example from an exit of the wet conveying process to the process of being dried. FIG. 6 is a schematic diagram in which the web substrate is conveyed from the exit of the wet conveying process and is dried. The web substrate 1 that has been subjected to chemical solution treatment in the wet conveying process 4 is conveyed while carrying the chemical solution used in the wet conveying process 4. This carried chemical solution is scraped and removed by drain rolls 2. Subsequently, the web substrate 1 is dried by a drier 3, and is conveyed via a guide roll 5 to the subsequent process. At this time, because the drain rolls 2 can increase a draining efficiency by applying contact pressure to the whole of the web substrate 1 in its width direction, a configuration of nipping with elastic rolls is preferably used therefor. Each elastic roll is required to have a plurality of properties such as suitable flexibility, durability to chemical solutions to be used, and wear resistance at the same time, and thus is generally designed using an elastomer having a multilayer structure such that needed functions are obtained at needed positions.

Patent Literature 1 describes a configuration of a common multilayer structure elastic roll as a conventional art. A structure thereof is illustrated in FIG. 7(*a*). A rubber elastic body 302 is wound around a shaft 301, and a synthetic resin layer 303 is coated on the outer periphery thereof. With this configuration, the synthetic resin layer 303 can have durability to chemical solutions, and also have needed flexibility imparted by the rubber elastic body 302. However, the rubber elastic body 302 is exposed at both ends of the roll, and the rubber elastic body 302 will be damaged from these exposed portions when a chemical solution that affects the rubber elastic body 302 is used. In the invention of Patent Literature 1, in order to prevent such damage, the rubber elastic body 302 is coated up to both end surfaces thereof with the synthetic resin layer 303 and also coating members 304 are fixed thereon as illustrated in FIG. 7(*b*), whereby damage from both end surfaces thereof is prevented from developing.

Patent Literature 2 proposes a roll including an elastic body layer 312 formed on an outer peripheral portion of a roll core 311 and a mold-release layer 313 formed on an outer peripheral portion of the elastic body layer 312 and having a gas barrier property. A structure thereof is illustrated in FIG. 8. In order to obtain the gas barrier property on both end surfaces of the elastic body layer 312, fixing plates 315 having a gas barrier property and configured to fix sealing plates 314 are provided. With this configuration, outgas from the elastic body layer 312 is prevented from leaking outside.

PATENT LITERATURE

Patent Literature 1: Japanese Patent Application Laid-open No. 2000-330374

Patent Literature 2: Japanese Patent Application Laid-open No. 2007-193059

SUMMARY OF THE INVENTION

In the configuration disclosed in Patent Literature 1, when adhesiveness of the synthetic resin layer 303 to the shaft material is poor, entry of the chemical solution from between the synthetic resin layer 303 and the shaft 301 cannot be prevented. Furthermore, the structure thereof cannot increase force of bringing the coating member 304 into tight contact therewith, and thus sealing performance thereof is low. Consequently, when a material having low durability to the chemical solution is used as the rubber elastic body 302 on a side closer to an inner layer, the inner layer is highly likely to be damaged by the chemical solution.

In the configuration disclosed in Patent Literature 2, the mold-release layer 313 and the sealing plates 314 are different members, and thus the positions of the fixing plates 315 vary depending on how the sealing plates 314 are compressed even if fastening forces of fixing bolts 316 are increased in order to bring the sealing plate 314 into tight contact. Consequently, variations arise in compressing force of the elastic body layer 312 in a roll circumferential direction, which makes it difficult to achieve uniform sealing and also makes it difficult to prevent entry of the chemical solution.

As described above, in the conventional art, because entry of a chemical solution into the inner layer cannot be prevented completely, there are problems in which a material having low durability to the chemical solution cannot be used for the inner layer or life decreases when the material is used. Consequently, room for choice for materials is limited, and it is difficult to provide a configuration that can satisfy the required functions at a high level.

In view of the problems in the conventional art, an object of the present invention is to enable materials for an inner-layer elastic body to be selected according to various functions without considering durability to chemical solutions, and to provide an elastic roll that can satisfy required functions such as chemical resistance and roll hardness at a high level.

An elastic roll according to embodiments of the present invention to solve the problem described above includes: a roll core; an inner-layer laminate covering an outer-peripheral surface of the roll core parallel to a roll longitudinal direction; a surface-layer elastomer including a tubular portion covering an outer-peripheral surface of the inner-layer laminate, and edge portions connected to the tubular portion, covering both end surfaces of the inner-layer laminate orthogonal to the roll longitudinal direction, and arranged in a manner being in contact with the roll core; and end-portion sealing structural bodies configured to press the edge portions of the surface-layer elastomer against the roll core.

A nip roll according to embodiments of the present invention is the elastic roll of the present invention is used to drain a chemical solution carried by conveyance of a web substrate in a process of bringing the chemical solution into contact with the web substrate. The inner-layer laminate is formed of an elastomer, and an elastomer forming the surface-layer elastomer is formed with a material having hardness higher than that of the elastomer forming the inner-layer laminate and also having higher resistance to the chemical solution.

A conveyance device according to embodiments of the present invention includes a process of bringing a chemical solution into contact with a web substrate, and a nipping mechanism. A nip roll used for the nipping mechanism is the nip roll of the present invention.

In the present invention, the "chemical solution" refers to water, oils, organic solvents, other liquid chemical agents in general, and liquid mixtures thereof, or a solution in which a solid chemical agent is dissolved.

According to the present invention, the elastic roll that enables high-level optimization of functions such as chemical resistance and wear resistance required to the roll surface and functions such as flexibility required to the elastic body can be provided.

Furthermore, with the elastic roll of the present invention, the nip roll having high quality and long life, and the conveyance device using the nip roll can be provided.

DETAILED DESCRIPTION OF EMBODIMENTS OF THE INVENTION

Cases in which examples of embodiments of the present invention are applied to a nip roll will now be described with reference to the drawings.

Figure 1:
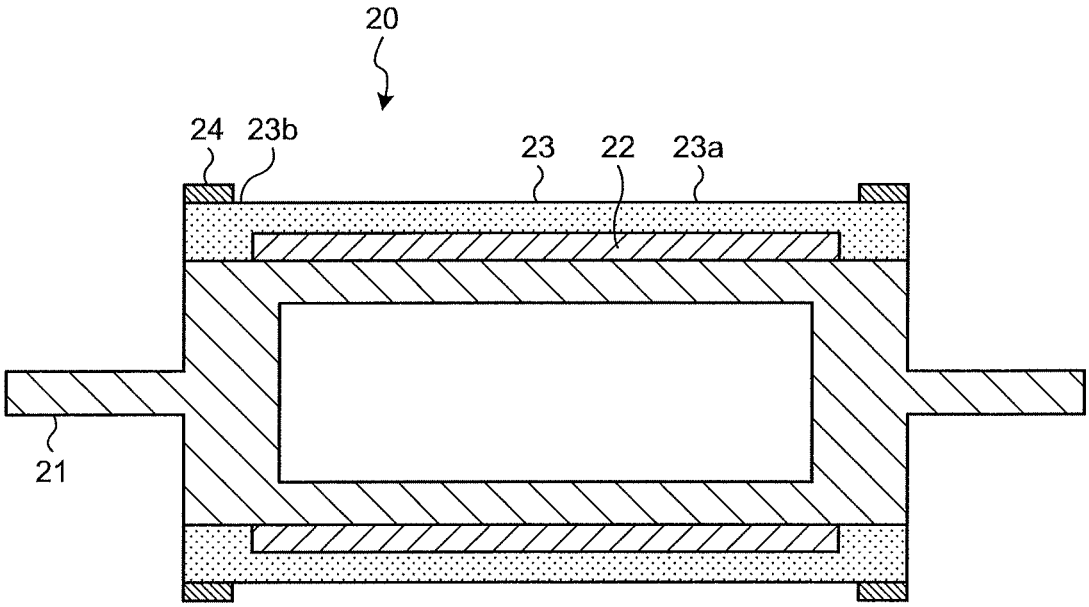
FIG. 1 is a sectional view illustrating main components according to an embodiment in which the present invention is applied to a nip roll.

FIG. 1 is a sectional view illustrating main components according to an embodiment in which an elastic roll of the present invention is used as a nip roll. A nip roll 20 includes: a roll core 21; an inner-layer laminate 22 covering an outer-peripheral surface of the roll core 21 parallel to a roll longitudinal direction; a surface-layer elastomer 23 having a tubular portion 23*a* covering an outer-peripheral surface of the inner-layer laminate 22 and edge portions 23*b* connected to the tubular portion 23*a*, covering both end surfaces of the inner-layer laminate 22 orthogonal to the roll longitudinal direction, and arranged in a manner being in contact with the roll core 21; and end-portion sealing structural bodies 24 configured to press the edge portions 23*b* of the surface-layer elastomer 23 against the roll core 21.

Around the outer-peripheral surface of the roll core 21 except both end portions thereof in the roll longitudinal direction, the inner-layer laminate 22 is wound. The surface-layer elastomer 23 is wound so as to cover the outer-peripheral surface of the inner-layer laminate 22 and both end surfaces thereof in the roll longitudinal direction. The edge portions 23*b* of the surface-layer elastomer 23 are in contact with the roll core 21. The edge portions 23*b* of the surface-layer elastomer 23 that are in contact with the roll core 21 are pressed against the roll core 21 by the end-portion sealing structural bodies 24.

The roll core 21 generally has a cylindrical shape on both ends of which shafts configured to serve as bearing fitted portions are formed, but may have various shapes depending on functions required to the roll and intended use, for example. Similarly, as an internal structure thereof, various structures may be used. As a material thereof, various materials such as plastic and metal may be used. However, from a viewpoint of durability, metallic materials such as iron and stainless steel are often used in general. Stainless steel excellent in corrosion resistance is preferably used particularly when it is used in a process using a chemical solution.

The inner-layer laminate 22 wound around the outer-peripheral surface of the roll core 21 is often bonded onto the roll core 21 with adhesive in general, and thus a material having adhesiveness to the material of the roll core 21 is preferably used therefor. As the material, a plastic or an elastomer in various types may be appropriately selected to be used according to required functions. For example, when hardness of the roll is wanted to be reduced, ethylene propylene rubber, silicone rubber, urethane rubber, or laminated rubber thereof or the like that enables the inner-layer laminate 22 to have lower hardness can be used. Alternatively, using polyvinyl chloride or ABS resin, for example, for the inner-layer laminate 22 enables a roll having higher hardness to be provided while reducing the volume of the inner-layer laminate 22.

The surface-layer elastomer 23 covering the outer-peripheral surface and both end surfaces of the inner-layer laminate 22 is preferably bonded onto the inner-layer laminate 22, and is more preferably bonded also onto the roll core 21. A material thereof is selected appropriately according to functions required of a surface of the nip roll 20. Consequently, when the adhesiveness of the surface-layer elastomer 23 to the inner-layer laminate 22 is poor, it is preferable to change the material of the inner-layer laminate 22. Adhesiveness is determined generally depending on compatibility with each other among the surface-layer elastomer 23, the inner-layer laminate 22, and an adhesive. However, because the surface-layer elastomer 23 herein is brought into direct contact with a web substrate and a chemical solution as described later, the material should be selected such that the functions required of the nip roll 20 are implemented to the greatest extent possible at the highest priority. A material having excellent adhesiveness to the material of the surface-layer elastomer 23 thus selected only needs to be selected as the material of inner-layer laminate 22. Pressure uniformity in the roll width direction that is one of properties of the nip roll 20 tends to be more excellent when the hardness of the whole laminate wound around the outer periphery of the roll core is lower. However, because the surface-layer elastomer 23 that is brought into direct contact with the web substrate and the chemical solution is required to have high resistance to the chemical solution, options for the material are limited. Thus, it is preferable that the hardness of the whole laminate can be adjusted over a wide range by setting the hardness of the elastomer forming the inner-layer laminate 22 to be lower than that of the elastomer forming the surface-layer elastomer 23.

When being used under environments in which a chemical solution such as water, oil, or an organic solvent adheres to the nip roll 20, a material that is not easily eroded by the chemical solution to be used is preferably used for the surface-layer elastomer 23. For example, ethylene propylene rubber is not suitable under environments in which mineral oil adheres thereto, and nitrile rubber is not suitable under environments in which phosphoric ester-based hydraulic oil adheres thereto. Under environments in which an organic solvent such as butyl acrylate, acetic acid, or dichlorobenzene that tends to erode many materials adheres thereto, room for choice for materials is significantly limited, and thus the choice has to be made considering, at high priority, that the material has resistance to the chemical solution to be used. Thus, a case may arise in which a material having poor adhesiveness to the roll core 21 has to be selected. Even if bonding can be made, there may be a case in which an adhesive layer formed between the surface-layer elastomer 23 and the roll core 21 is eroded by the chemical solution. In such cases, the chemical solution will enter from a gap between the roll core 21 and the surface-layer elastomer 23 to erode the inner-layer laminate 22.

In view of this, in an embodiment of the present invention, in order to prevent the chemical solution from entering from the gap between the roll core 21 and the surface-layer elastomer 23, a structure is used in which the edge portions 23*b* of the surface-layer elastomer 23 are strongly pressed against the roll core 21 by the end-portion sealing structural bodies 24. The roll core 21 is a member having high stiffness, and thus a problem in which pressing force disperses and the sealing performance accordingly decreases can be avoided. As the configuration of the end-portion sealing structural body 24, any structure may be used if the function of pressing the edge portions 23*b* against the roll core 21 is implemented. For example, a ring-shaped member having an inside diameter smaller than the outside diameter of the edge portions 23*b* may be attached, or a structure of inserting a cylindrical member the inside diameter of which is tapered may be used.

A structure may be used in which the end-portion sealing structural body 24 includes a sealing member and a pressing mechanism, the pressing mechanism is configured to press the sealing member against the roll core 21, and the sealing member is configured to press the edge portions 23*b* against the roll core 21. Examples of this structure include a structure commonly called "hose band" for clamping with a band-shaped structural body the inside diameter of which decreases when a screw is tightened. The band-shaped structural body corresponds to the sealing member, and the screw corresponds to the pressing mechanism.

The material used for the end-portion sealing structural bodies 24 is preferably a material having resistance to the chemical solution to be used.

In the embodiment in FIG. 1, the outer shape of the surface-layer elastomer 23 is a flat cylindrical shape. However, the outside diameter thereof may be a radial crown shape, may be a shape having end portions that are tapered to a certain extent to reduce the outside diameter at both ends (hereinafter, called "end-portion tapered shape"), or may be a shape having such steps that the largest outside diameter of the end-portion sealing structural bodies 24 is not larger than the outside diameter of the edge portions 23*b* (hereinafter, called "grooved shape"). Similarly, the inner-layer laminate 22 may have a shape in various types such as the radial crown shape, the end-portion tapered shape, the grooved shape.

Figure 2:
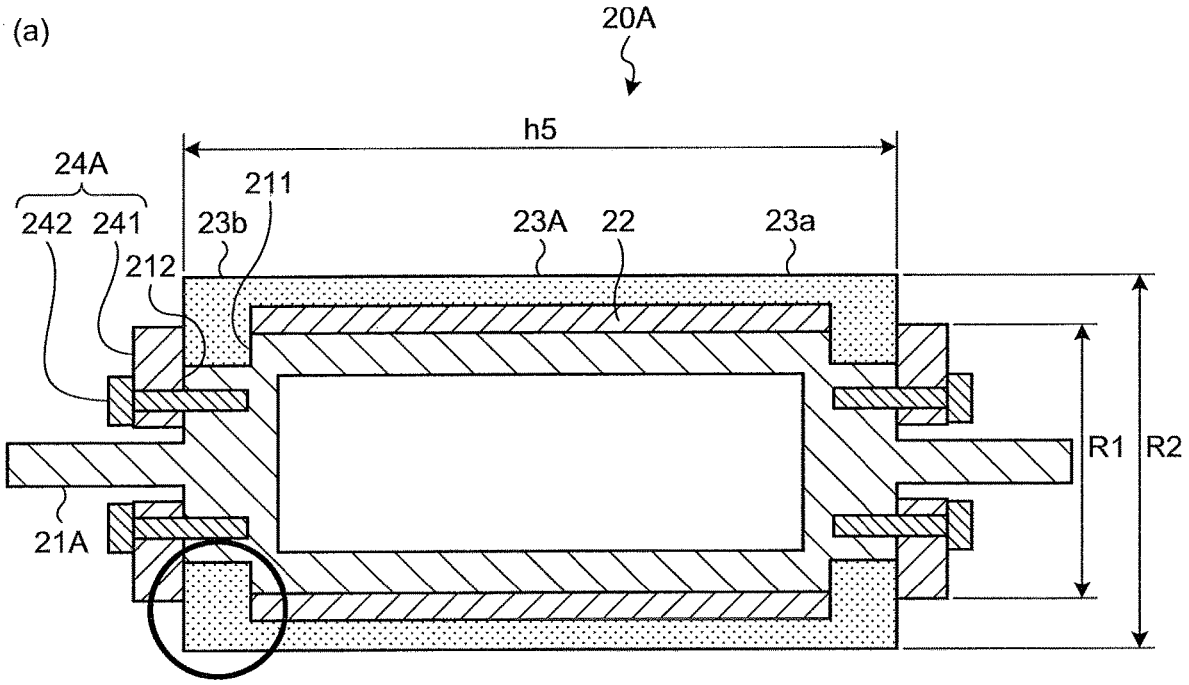
FIG. 2 are sectional views illustrating main components according to another embodiment in which the present invention is applied to the nip roll.
Figure 2:
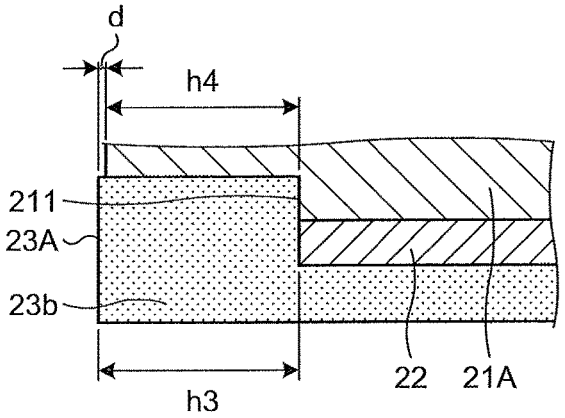

FIG. 2 are a sectional view (FIG. 2(*a*)) illustrating main components of another embodiment in which the elastic roll of the present invention is used as a nip roll and a partially enlarged view (FIG. 2(*b*)) of the portion surrounded by a black circle in FIG. 2(*a*). This nip roll 20A has a configuration in which steps 211 are formed on outer-peripheral surfaces of a roll core 21A at portions that are not covered by the inner-layer laminate 22 such that the diameter of a roll core 21A decreases toward end portions thereof. In this configuration, edge portions 23*b* of a surface-layer elastomer 23A covering both end surfaces of the inner-layer laminate 22 also cover stepped surfaces of the roll core 21, and are in contact with the roll core 21. Onto end surfaces of the roll core 21A orthogonal to the roll longitudinal direction, end-portion sealing structural bodies 24A are attached, and each end-portion sealing structural body 24A includes a sealing member 241 and pressing mechanisms 242. In this structure, the sealing member 241 is pressed by the pressing mechanisms 242 such as typically bolts against the roll core 21 in the roll longitudinal direction. Using this pressing force, the sealing members 241 press both end portions of the surface-layer elastomer 23 covering both end surfaces of the inner-layer laminate 22, which are the edge portions 23*b* covering the stepped surfaces of the roll core 21, against the stepped surfaces of the roll core 21 in the roll longitudinal direction. In this structure, pressing force against the stepped surfaces of the roll core 21A with the surface-layer elastomer 23A is securely applied as described above. Thus, the chemical solution is prevented from entering from a gap between the surface-layer elastomer 23A and the roll core 21A.

Figure 3:
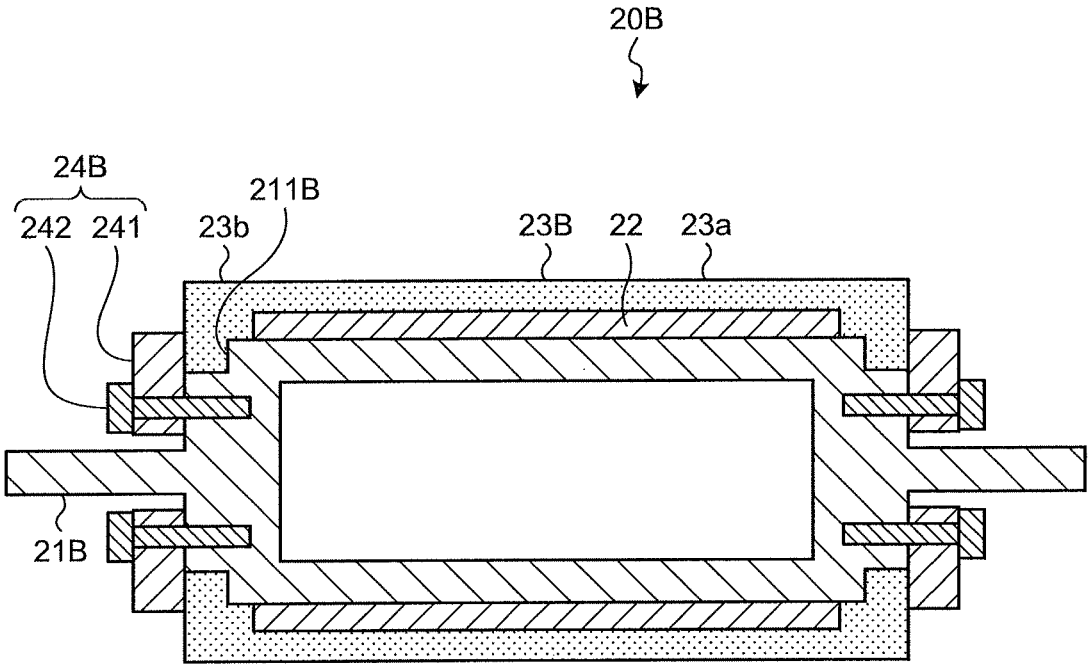
FIG. 3 is a sectional view illustrating main components according to another embodiment in which the present invention is applied to the nip roll.

As illustrated in FIG. 3, also in a nip roll 20B in which steps 211B are formed on outer-peripheral surfaces of a roll core 21B from midpoints on portions that are not covered by the inner-layer laminate 22 to decrease the outside diameter, the same effect can be obtained if end-portion sealing structural bodies 24B are structured to press edge portions 23*b* of a surface-layer elastomer 23B against stepped surfaces of the roll core 21B. The end-portion sealing structural bodies 24B have the same configuration as that of the end-portion sealing structural bodies 24A.

In the nip roll 20A illustrated in FIG. 2, as for the positional relation between a surface of the roll core 21A that is orthogonal to the roll longitudinal direction and on which each end-portion sealing structural body 24A is placed and an end surface of the corresponding edge portion 23*b* of the surface-layer elastomer 23A, the thickness h3 of the edge portion 23*b* in the roll longitudinal direction is greater than the height h4 of the corresponding step 211 by a length of d as illustrated in FIG. 2(*b*) when these portions are not pressed by the corresponding sealing member 241. The sealing member 241 compresses the surface-layer elastomer 23A while being in tight contact with the roll-core 21. This causes strong compressing force to be generated in the surface-layer elastomer 23A, thereby enhancing adhesion between the surface-layer elastomer 23A and the roll core 21A to increase the sealing performance. Furthermore, because the fixed position is mechanically determined when the sealing member 241 comes into tight contact with the roll core 21A, variations in compressing force of the surface-layer elastomer 23A in the roll circumferential direction can be reduced, whereby uniform sealing can be achieved. The above-described effects can be obtained in the same manner also in the nip roll 20B. Hereinafter, when the sealing member 241 is pressed in the roll longitudinal direction, a surface of the roll core 21A that comes into contact with the sealing member 241 is called a contact surface 212 of the roll core 21.

Figure 8:
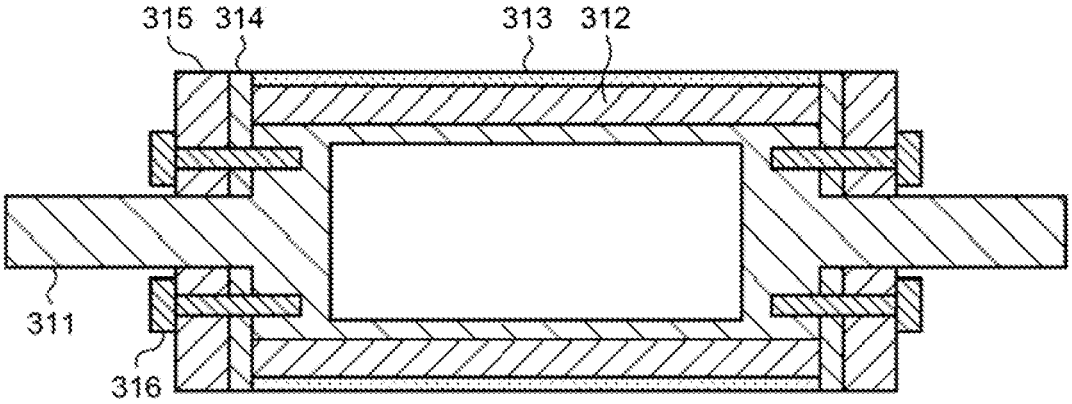
FIG. 8 (Prior Art)
FIG. 8 is a diagram illustrating main components of an elastic roll disclosed in Patent Literature 2.

In the structure of Patent Literature 2 illustrated in FIG. 8, fixing plates 315 are pressed against a base 311 by fixing bolts 316, whereby adhesion between each sealing plate 314 and an elastic body layer 312 is enhanced to obtain a sealing effect. In this method, because the positions of the fixing plates 315 vary depending on how the sealing plates 314 are compressed, variations arise in compressing force of the elastic body layer 312 in the roll circumferential direction, which makes it difficult to achieve uniform sealing.

When the thickness h3 of the edge portion 23*b* is greater than the height h4 of the step 211, the protruding length d of the edge portion 23*b* can provide sufficient adhesion between the surface-layer elastomer 23 and the roll core 21. The protruding length d is preferably 0.3 mm or more. The upper limit of the protruding length d is not limited to a particular value. However, the protruding length d may be set within a range that enables the sealing member 241 to come into tight contact with the contact surface 212 of the roll core 21A while being pressed in the roll longitudinal direction, and can be appropriately determined according to the material of the surface-layer elastomer 23A and the compressing force in the roll longitudinal direction.

Furthermore, in the nip roll 20A, it is preferable that the maximum outside diameter R1 of the sealing member 241 be set smaller than the outside diameter R2 of the surface-layer elastomer 23A (i.e., the size of the sealing member 241 be set such that its profile projected in the roll longitudinal direction is contained inside the outermost periphery of the surface-layer elastomer 23A in a plane orthogonal to the roll longitudinal direction) because this setting enables the nip roll 20A to be used also for a nip system to be nipped having a roll surface length that is greater than the nip roll surface length h5. There are occasions when outside diameters of the edge portions 23*b* of the surface-layer elastomer 23A bulge due to compressing force applied by the end-portion sealing structural bodies 24A, and accordingly contact pressure against a roll to be nipped rises locally. For applications in which such contact pressure distribution is not preferable, it is preferable to taper the edge portions 23*b* of the surface-layer elastomer 23A to reduce the outside diameter thereof.

Figure 4:
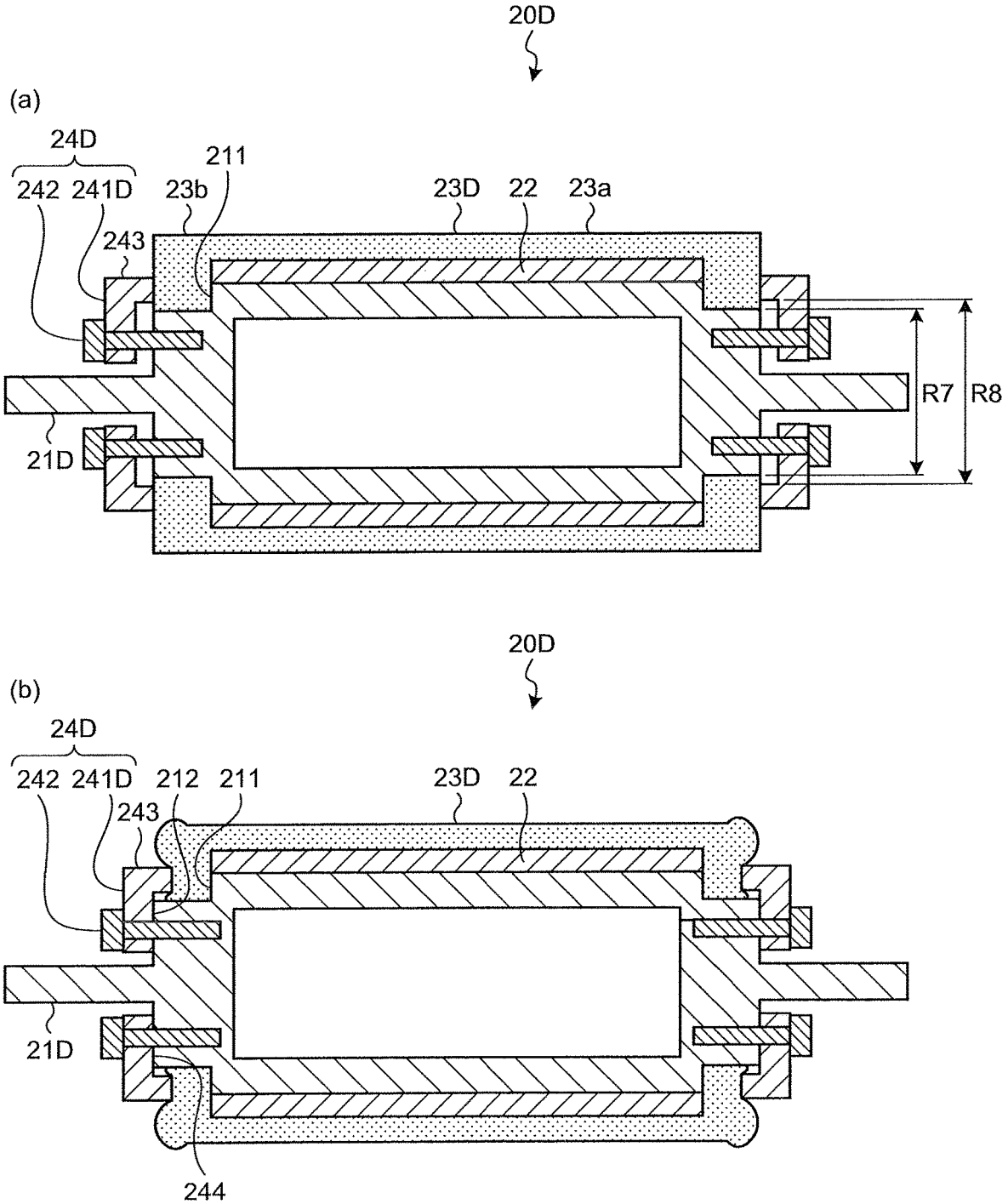
FIG. 4 are sectional views illustrating main components according to another embodiment in which the present invention is applied to the nip roll, including a sectional view (FIG. 4(*a*)) illustrating a state in which sealing members are not pressed and a sectional view (FIG. 4(*b*)) illustrating a state in which the sealing members are pressed.

FIG. 4 are sectional views illustrating main components according to another embodiment in which the elastic roll of the present invention is used as a nip roll. FIG. 4(*a*) illustrates a state in which sealing members 241D are not pressed in the roll longitudinal direction against stepped surfaces 211 of a roll core 21D, and FIG. 4(*b*) illustrates a state in which the sealing members 241D are pressed. The sealing members 241D of the nip roll 20D illustrated in FIG. 4 are members obtained by forming, on outer peripheries of the sealing members 241 of the nip roll 20A illustrated in FIG. 2, annular projections 243 each protruding toward the surface-layer elastomer 24A. The inside diameter R8 of the projections 243 is set larger than the outside diameter R7 of the steps 211, and the sealing members 241D are structured to push the surface-layer elastomer 23D such that it is dented by the length of the projections 243 when the inner walls 244 thereof are in tight contact with the contact surfaces 212 of the roll core 21. This is preferable because adhesion between the surface-layer elastomer 23D and the roll core 21D can be further increased. If a gap adjusting member (not illustrated) such as a shim is inserted between each sealing member 241D and the roll core 21D, the pushing length of the corresponding projection 243 into the surface-layer elastomer 23D can be adjusted, whereby adhesion between the surface-layer elastomer 230 and the roll core 21D can be adjusted. Furthermore, in the nip roll 20D, by the protruding length of the projection 243, the corresponding end surface of the surface-layer elastomer 23D can be pushed more than the corresponding contact surface 212 of the roll core 21D can. This eliminates the need of processing for accurately adjusting the positional relation between the contact surface 212 of the roll core 21D and the end surface of the surface-layer elastomer 23D, thereby facilitating design and manufacture of the roll.

Figure 5:
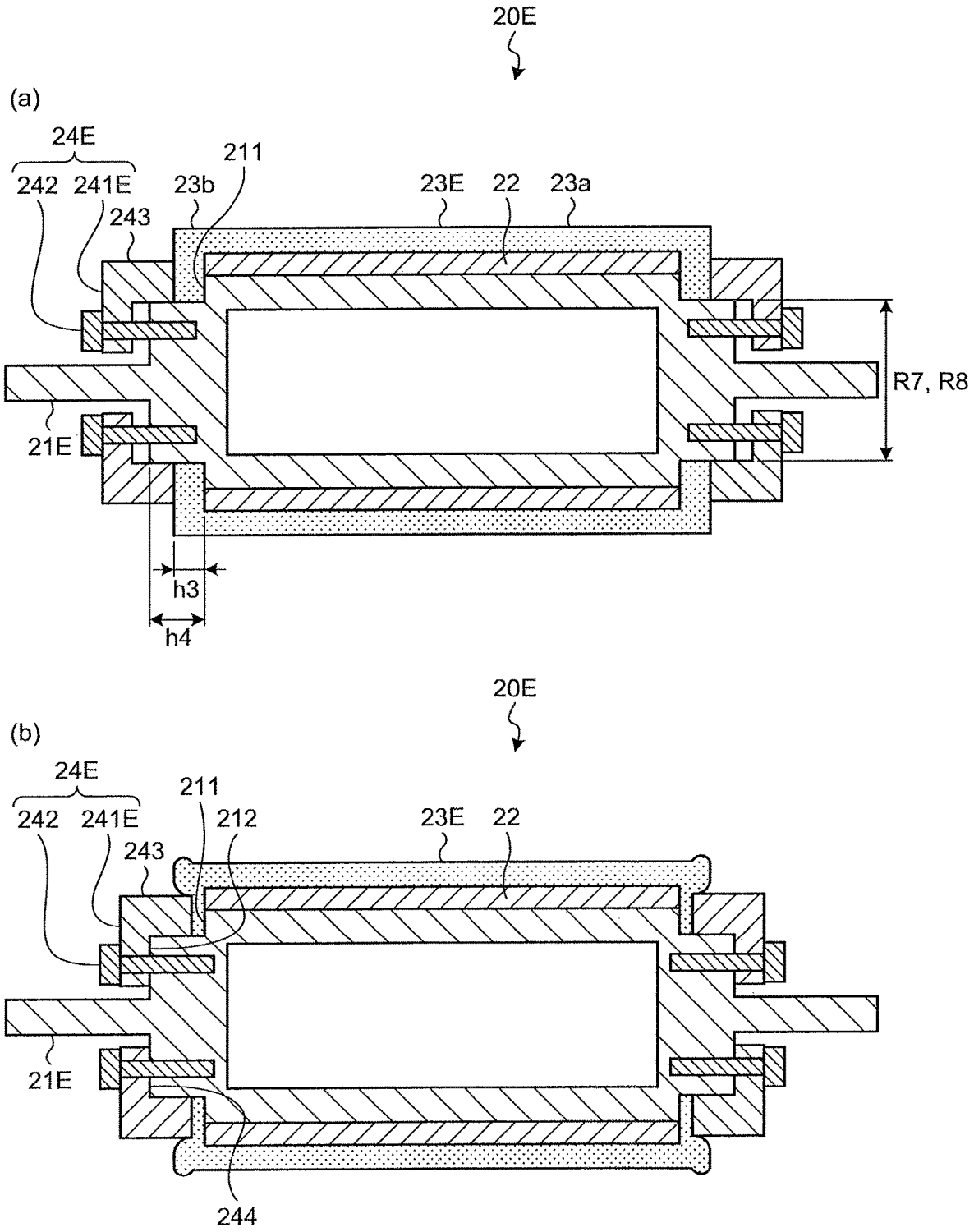
FIG. 5 are sectional views illustrating main components according to another embodiment in which the present invention is applied to the nip roll, including a sectional view (FIG. 5(*a*)) illustrating a state in which sealing members are not pressed and a sectional view (FIG. 5(*b*)) illustrating a state in which the sealing members are pressed.
Figure 6:
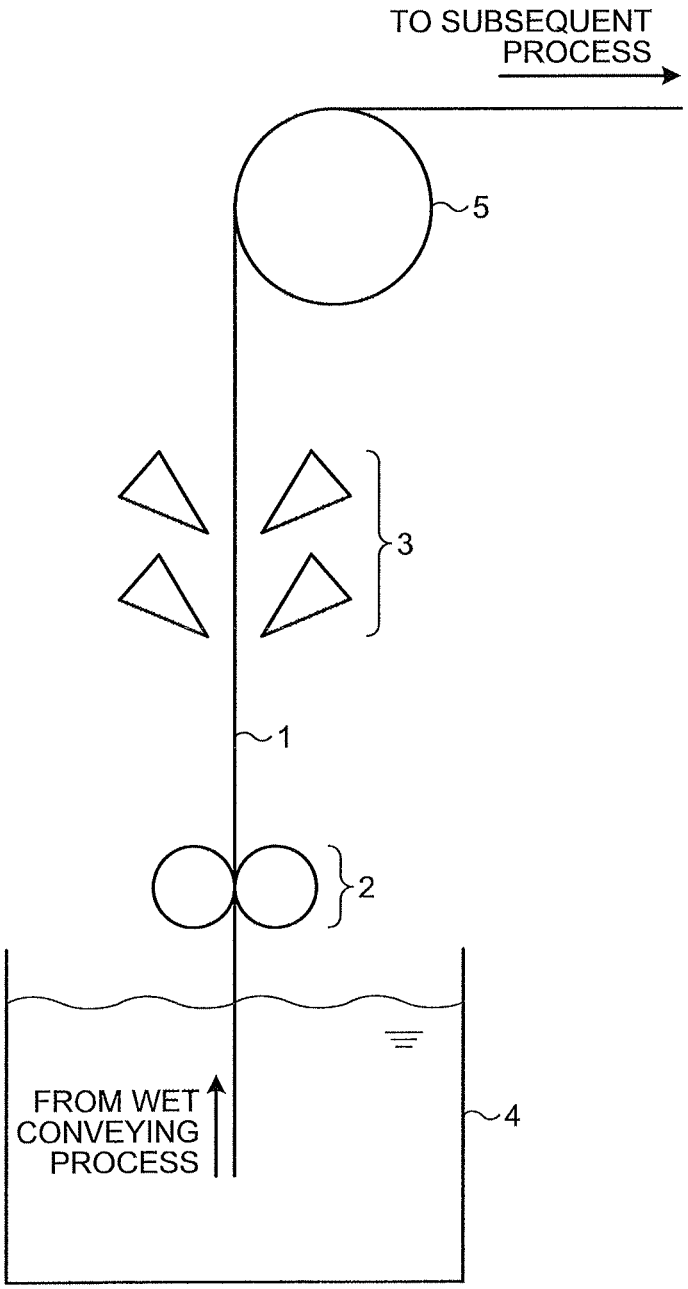
FIG. 6 is a schematic diagram illustrating one example of a vicinity of an exit of a wet conveying process.
Figure 7:
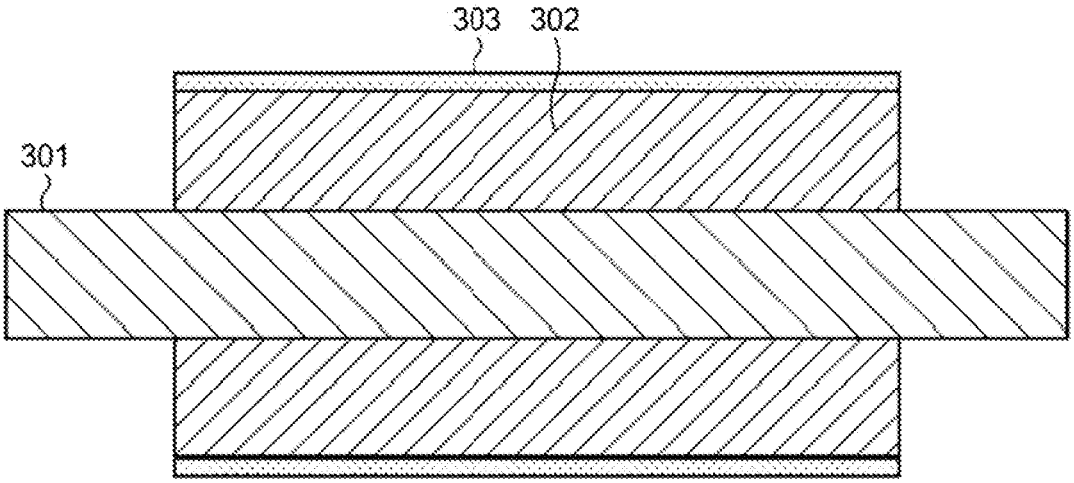
FIG. 7 (Prior Art)
FIG. 7 are diagrams illustrating main components of elastic rolls disclosed in Patent Literature 1, including FIG. 7(*a*) illustrating a conventional art in Patent Literature 1 and FIG. 7(*b*) illustrating a technique of Patent Literature 1.
Figure 7:
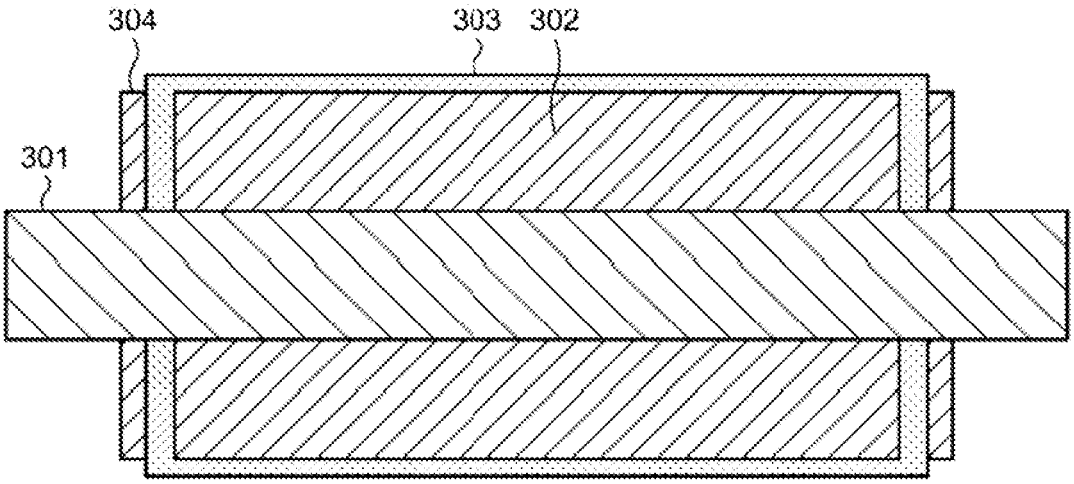
FIG. 7 (Prior Art)

FIG. 5 are sectional views illustrating main components according to still another embodiment in which the elastic roll of the present invention is used as a nip roll. FIG. 5(*a*) illustrates a state in which sealing members 241E are not yet pressed in the roll longitudinal direction against stepped surfaces of a roll core 21E, and FIG. 5(*b*) illustrates a state in which the sealing members 241E are pressed. In the nip roll 20E illustrated in FIG. 5, the thickness h3 of edge portions 23*b* in the roll longitudinal direction is smaller than the height h4 of steps 211. Consequently, on surfaces of the steps 211 of the roll core 21E parallel to the roll longitudinal direction, exposed areas that are not covered by the surface-layer elastomer 23E are present. Furthermore, the innermost diameter R8 of projections 243E of the sealing members 241E is the same as the outside diameter R7 of the steps 211, and the projection 243E of each sealing member 241E is structured to press the corresponding edge portion 23*b* of the surface-layer elastomer 23E in the roll longitudinal direction when the corresponding exposed area of the roll core 21E and an inner-peripheral portion of the projection 243E are fitted together. This facilitates centering adjustment between the corresponding end-portion sealing structural body 24E and the roll core 21E, and thus the concentricity between the end-portion sealing structural body 24E and the roll core 21E can be increased, and eccentricity of the roll can be reduced.

The above-described nip rolls 20, 20A, 20B, 20D, and 20E in which the elastic roll of the present invention is used can prevent the inner-layer laminate 22 from being eroded by the chemical solution and the like to be used. Thus, by using these nip rolls as drain rolls in a web conveyance device for the purpose of chemical solution treatment, the functions thereof can be implemented stably for a long period of time.

In the elastic roll of the present invention, because the surface-layer elastomers 23 to 23E exert resistance to the chemical solution and the like, the need of requiring resistance to the chemical solution and the like of the inner-layer laminate 22 is eliminated. Thus, an optimum material for the inner-layer laminate 22 can be selected in consideration of properties such as roll hardness, and the range of choice for materials of the inner-layer laminate 22 is extended. The edge portions 23*b* of the surface-layer elastomers 23 to 23E are pressed by the end-portion sealing structural bodies 24 to 24E against the roll cores 21 to 21E, respectively, which eliminates the need of considering adhesiveness between each of the surface-layer elastomers 23 to 23E and the corresponding one of the roll cores 21 to 21E. Thus, an optimum material for the surface-layer elastomers 23 to 23E can be selected in consideration of properties such as chemical-solution resistance, and also the range of choice for materials of surface-layer elastomers 23 to 23E is extended. Consequently, the elastic roll of the present invention can achieve high-level compatibility of required functions such as roll hardness and durability to chemical solutions that generally conflict with each other.

In the description of the embodiments above, cases in which the elastic roll of the present invention is used as a nip roll have been described. However, the present invention is not limited to these cases, and the elastic roll may be used as a coating roll, a laminate press roll, a conveyance roll, a sizing roll, a mangle roll, a scouring roll, a touch roll, and an ink roll, for example.

EXAMPLES

Roll durability to a chemical solution was evaluated in Examples and Comparative Examples described below.

Example 1

With the nip roll 20D illustrated in FIG. 4, a test of immersing it in a chemical solution and rotating it was conducted under the following conditions.

(1) Roll Structure

Surface-layer elastomer: Fluorine-containing rubber (having resistance to the chemical solution to be used)

Inner-layer laminate: Synthetic rubber (without resistance to the chemical solution to be used)

Roll core: SUS316

Protruding length of projections: 0.5 mm (2) Immersion Conditions

Chemical solution: Dichlorobenzene

Immersion period: Two weeks

As a result of the test, the volume change of the nip roll 20D between before and after the test was smaller than 1%. The volume change was calculated by the following formula after determining the volumes of an elastomer portion before and after the test.

$$\text{Volume change (\%)}=\{(\text{Volume of elastomer portion after test})-(\text{Volume of elastomer portion before test})\}/(\text{Volume of elastomer portion before test})\times 100$$

As for each volume of the elastomer portion, the cross-sectional area of the elastomer portion was determined based on the average outside diameter of the surface-layer elastomer and the outside diameter of the roll-core, and a product of the cross-sectional area of the elastomer portion and the length of the surface-layer elastomer in the roll longitudinal direction was obtained as the volume of the elastomer portion (the surface-layer elastomer and the inner-layer laminate). The average outside diameter of the surface-layer elastomer was obtained by measuring outside diameters thereof at pitches into which the length thereof in the roll longitudinal direction was evenly divided by 100 while changing positions in the roll longitudinal direction, and then averaging the measured outside diameters.

Example 2

With the nip roll 20A illustrated in FIG. 2, a test was conducted using the following roll structure under the same immersion conditions as in Example 1.

(1) Roll Structure

Surface-layer elastomer: Fluorine-containing rubber (having resistance to the chemical solution to be used)

Inner-layer laminate: Synthetic rubber (without resistance to the chemical solution to be used)

Roll core: SUS316

Protruding length of surface-layer elastomer (reference sign "d" in FIG. 2): 0.3 mm As a result of the test, the volume change between before and after the test was smaller than 1%.

Example 3

With the nip roll 20 illustrated in FIG. 1, a test was conducted using the following roll structure under the same immersion conditions as in Example 1.

(1) Roll Structure

Surface-layer elastomer: Fluorine-containing rubber (having resistance to the chemical solution to be used) Inner-layer laminate: Synthetic rubber (without resistance to the chemical solution to be used)

Roll core: SUS316

It was known that the surface-layer elastomer had sufficient resistance to the chemical solution to be used. By applying sufficient pressure with the end-portion sealing structural bodies to press the surface-layer elastomer against the roll core, the used chemical solution did not enter the inner-layer laminate, and consequently the volume change was reduced to be smaller than 1%.

Comparative Example 1

The same test as in Example 1 except that the end-portion sealing structural bodies were removed was conducted, and consequently the volume change exceeded 5%.

Comparative Example 2

With the roll illustrated in FIG. 8, a test was conducted using the following roll structure under the same immersion conditions as in Example 1.

(1) Roll Structure

Mold-release layer (surface-layer elastomer): Fluorine-containing rubber (having resistance to the chemical solution to be used)

Elastic body layer (inner-layer laminate): Synthetic rubber (without resistance to the chemical solution to be used)

Sealing plates: Fluorine-containing rubber (having resistance to the chemical solution to be used)

Roll core: SUS316

As a result of the test, the volume change exceeded 5%.

Comparative Example 3

With the roll illustrated in FIG. 8, a test was conducted using the following roll structure under the same immersion conditions as in Example 1.

(1) Roll Structure

Mold-release layer (surface-layer elastomer): Fluorine-containing rubber (having resistance to the chemical solution to be used)

Elastic body layer (inner-layer laminate): Synthetic rubber (without resistance to the chemical solution to be used)

Sealing plates: Fluorine-containing resin coating (having resistance to the chemical solution to be used) Roll core: SUS316

As a result of the test, the volume change exceeded 5%. In observation after the test, cracks were found in the fluorine-containing resin.

Comparative Example 4

With the roll illustrated in FIG. 8, a structure was used that has the following roll structure and includes fixing plates on which annular projections were formed so as to push by the protruding length of the projections. At the moment when the fixing plates had been attached, cracks appeared in the sealing plates. The test was abandoned because it was obvious that the chemical solution to be used would enter from these cracks to erode the inner-layer laminate.

(1) Roll Structure

Mold-release layer (surface-layer-elastomer): Fluorine-containing rubber (having resistance to the chemical solution to be used)

Elastic body layer (inner-layer laminate): Synthetic rubber (without resistance to the chemical solution to be used)

Sealing plates: Fluorine-containing resin coating (having resistance to the chemical solution to be used) Roll core: SUS316

The present invention is highly preferable as an elastic nip roll used in a conveyance device configured to subject a web substrate to chemical solution treatment. However, the application range thereof is not limited to these.

REFERENCE SIGNS LIST

1 web substrate
2 drain roll
3 drier
4 wet conveying process
5 guide roll
d protruding length
20, 20A, 20B, 20D, 20E nip roll
21, 21A, 21B, 21D, 21E roll core
22 inner-layer laminate
23, 23A, 23B, 23D, 23E surface-layer elastomer
24, 24A, 24B, 24D, 24E end-portion sealing structural body
211 step
212 contact surface
241 sealing member
242 pressing mechanism
243, 243E projection
244 inner wall
301 shaft
302 rubber elastic body
303 synthetic resin layer
304 coating member
311 roll core (base)
312 elastic body layer
313 mold-release layer
314 sealing plate
315 fixing plate
316 fixing bolt

The invention claimed is:

1. An elastic roll comprising:
a roll core;
an inner-layer laminate covering an outer-peripheral surface of the roll core parallel to a roll longitudinal direction;
a surface-layer elastomer including
a tubular portion covering an outer-peripheral surface of the inner-layer laminate, and
edge portions connected to the tubular portion, covering both end surfaces of the inner-layer laminate orthogonal to the roll longitudinal direction, and arranged in a manner being in contact with the roll core; and
end-portion sealing structural bodies configured to press the edge portions of the surface-layer elastomer against the roll core.

2. The elastic roll according to claim 1, wherein
the end-portion sealing structural bodies include sealing members and pressing mechanisms,
each pressing mechanism is configured to press each sealing member against the roll core, and
the sealing members are configured to press the edge portions covering both the end surfaces of the inner-layer laminate against the roll core.

3. The elastic roll according to claim 2, wherein
the roll core includes, in areas that are not covered by the inner-layer laminate at both end portions of the roll core in the roll longitudinal direction, steps to cause a diameter of the roll core to decrease toward an end portion of the roll core in the roll longitudinal direction,
each edge portion of the surface-layer elastomer is in contact with a stepped surface of each step of the roll core, and
the sealing member is configured to press the edge portion of the surface-layer elastomer against the stepped surface in the roll longitudinal direction.

4. The elastic roll according to claim 3, wherein a thickness of the edge portion in the roll longitudinal direction is greater than a height of the step when the sealing member does not press the edge portion of the surface-layer elastomer against the stepped surface in the roll longitudinal direction.

5. The elastic roll according to claim 3, wherein
the sealing member includes an annular projection protruding toward the surface-layer elastomer, and
the pressing mechanism is configured to press the sealing member in the roll longitudinal direction to dent a portion of the edge portion being in contact with the annular projection.

6. The elastic roll according to claim 5, wherein
a thickness of the edge portion in the roll longitudinal direction is smaller than a height of the step, an exposed area that is not covered by the surface-layer elastomer is present on a surface of the step parallel to the roll longitudinal direction, and
an innermost diameter of the annular projection of the sealing member is a same as an outside diameter of the step, and an inner-peripheral portion of the annular projection and the exposed area of the step are fitted together.

7. The elastic roll according to claim 2, wherein a profile of the sealing member projected in the roll longitudinal direction has a size contained inside an outermost periphery of a cross-section of the surface-layer elastomer in a plane orthogonal to the roll longitudinal direction.

8. The elastic roll according to claim 1, wherein the end-portion sealing structural bodies are configured to press the edge portions against the roll core in a roll radial direction.

9. A nip roll comprising the elastic roll according to claim 1, the elastic roll being used, in a process in which a chemical solution comes into contact with a web substrate, to drain the chemical solution carried by conveyance of the web substrate, wherein the inner-layer laminate is formed of an elastomer, and has hardness lower than that of an elastomer forming the surface-layer elastomer, and the elastomer forming the surface-layer elastomer has high resistance to the chemical solution.

10. A conveyance device configured to bring a chemical solution into contact with a web substrate, the conveyance device comprising a nipping mechanism, wherein a nip roll used for the nipping mechanism is the nip roll according to claim 9.

* * * * *